US006371740B1

(12) United States Patent
Jansen

(10) Patent No.: US 6,371,740 B1
(45) Date of Patent: Apr. 16, 2002

(54) JET ENGINE FUEL DELIVERY SYSTEM WITH NON-PULSATING DIAPHRAGM FUEL METERING PUMP

(75) Inventor: Harvey B. Jansen, Mesa, AZ (US)

(73) Assignee: Jansen's Aircraft Systems Controls, Inc., Tempe, AZ (US)

( * ) Notice: Subject to any disclaimer, the term of this patent is extended or adjusted under 35 U.S.C. 154(b) by 0 days.

(21) Appl. No.: 09/568,370

(22) Filed: May 10, 2000

Related U.S. Application Data

(60) Provisional application No. 60/133,594, filed on May 11, 1999.

(51) Int. Cl.[7] ..... F04B 17/00

(52) U.S. Cl. ..... 417/413.1; 470/92; 470/71; 470/64

(58) Field of Search ..... 417/222.1, 413.1, 417/470; 92/64, 71

(56) References Cited

U.S. PATENT DOCUMENTS

| | | | | | |
|---|---|---|---|---|---|
| 2,991,723 | A | * | 7/1961 | Zubaty | 103/150 |
| 4,173,437 | A | | 11/1979 | Leka et al. | 417/521 |
| 4,392,787 | A | | 7/1983 | Notta | 417/269 |
| 4,436,230 | A | | 3/1984 | Hofmann | 222/614 |
| 4,486,151 | A | * | 12/1984 | Karhonen-Wesala | 417/222 X |
| 4,516,475 | A | * | 5/1985 | Fricke | 92/57 |
| 4,543,044 | A | | 9/1985 | Simmons | 417/342 |
| 4,734,187 | A | | 3/1988 | Visentin et al. | 210/101 |
| 4,797,069 | A | * | 1/1989 | Hartley | 417/222 |
| 4,971,523 | A | | 11/1990 | Wacker et al. | 417/63 |
| 4,990,066 | A | * | 2/1991 | Kern | 417/307 X |
| 5,066,199 | A | | 11/1991 | Reese et al. | 417/63 |
| 5,145,339 | A | | 9/1992 | Lehrke et al. | 417/521 |
| 5,167,181 | A | * | 12/1992 | Ken Lee | 91/499 |
| 5,368,451 | A | | 11/1994 | Hammond | 417/395 |
| 5,988,987 | A | * | 11/1999 | Wolcott | 417/54 |
| 5,993,174 | A | | 11/1999 | Konishi | 417/413.1 |
| 6,024,541 | A | * | 2/2000 | Perstnev | 417/269 |

* cited by examiner

*Primary Examiner*—Timothy S. Thorpe
*Assistant Examiner*—Ehud Gartenberg
(74) *Attorney, Agent, or Firm*—Quarles & Brady LLP

(57) ABSTRACT

Disclosed herein is a fuel metering pump for delivering fuel to rocket or jet engine having a motor driven face cam and a pair of reciprocating rolling diaphragm pump mechanisms movable through opposite suction and pump strokes. The face cam has a ramping cam surface that extends radially more than 180 degrees. This permits both pump mechanisms to be simultaneously in the pump stroke for a portion of the pump stroke so that they alternately reciprocate through the suction and pump strokes at essentially a constant velocity, thereby providing an essentially non-pulsating flow of fuel to the engine.

17 Claims, 3 Drawing Sheets

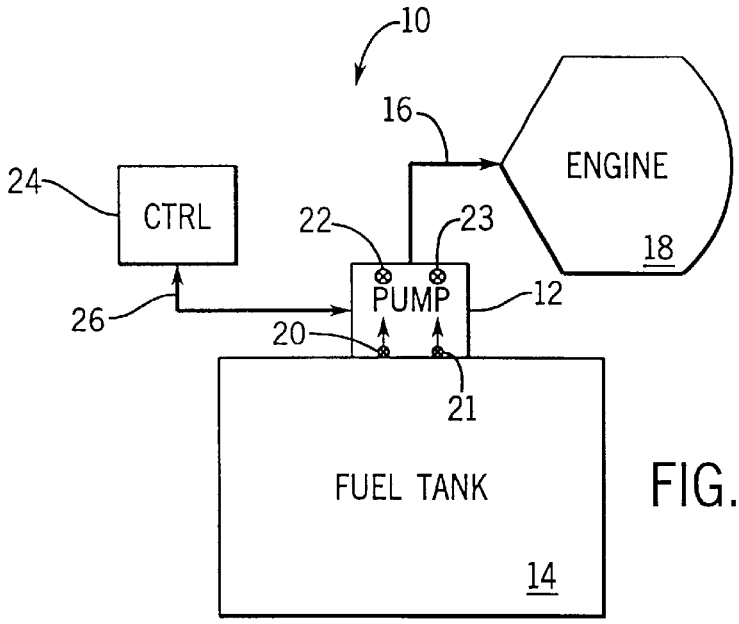
FIG. 1
FIG. 4
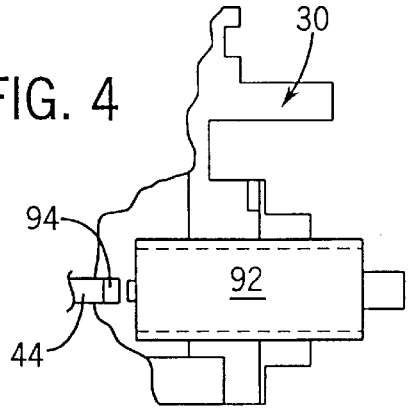
FIG. 5
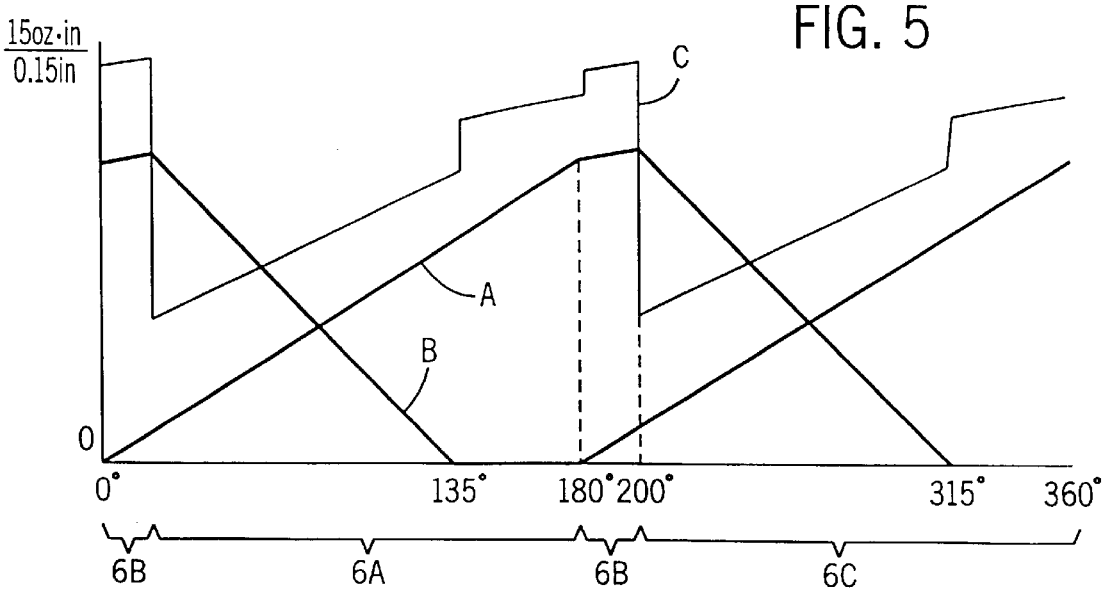

JET ENGINE FUEL DELIVERY SYSTEM WITH NON-PULSATING DIAPHRAGM FUEL METERING PUMP

CROSS-REFERENCE TO RELATED APPLICATIONS

This application claims benefit to provisional application Ser. No. 60/133,594, filed May 11, 1999.

STATEMENT REGARDING FEDERALLY SPONSORED RESEARCH OR DEVELOPMENT

Not applicable.

BACKGROUND OF THE INVENTION

The present invention relates to fuel delivery systems for stationary and propulsion gas turbine engines, and in particular, to rocket and jet engine fuel delivery systems having fuel metering pumps.

The high burn rates of rocket and jet engines requires the fuel delivery system to be capable of precisely metering fuel. Traditionally, fuel delivery systems for rocket and jet engines, particularly those used for propulsion, have included a fuel pump, a pressure accumulator and a fuel metering device, all of which being separate components mounted on or near the engine at distinct locations and coupled to the engine and fuel source by suitable fuel lines. The accumulator operates to dampen pulsation or ripple in the fuel caused by the pump so that the metering device can accurately dispense the appropriate amount of fuel to the engine fuel atomizer. The use of multiple components is expensive and occupies space, which is limited for propulsion systems.

It is desirable to reduce the number of components in the fuel delivery by combining the fuel pump and metering device into one unit. However, if one component is to serve as both the pump and the metering device, it must meet the requires of the rocket and jet engine industry for both the pump and the metering device. Some of the attributes of a jet engine fuel pump include the ability to pump particle contaminated fuel for an extended time period. It must have good dry lift capacity and be able to operate with vapor-to-liquid ratios at the pump inlet of 0.45 or greater. Moreover, if no accumulator or fluid muffler is to be used, the pump must also be able to provide generally non-pulsating fuel flow. The requirements of a jet engine metering device include low power consumption and low hysteresis, i.e., the ability to operate with high efficiency and low friction. The device must also be able to provide a wide range of flow rates accurately, i.e., have a high turn-down ratio. Additionally, the device must be compact and have minimal internal leakage.

Typically in the rocket and jet industry, the fuel delivery systems employ gear pumps which create a pressure differential by moving the fuel through a series of intermeshing teeth running at a high frequency. Gear pumps consume a lot of power and leak internally and are therefore less than ideal for rocket and jet engine use. Moreover, due to reliability concerns, gear pumps used for propulsion applications typically are powered by an engine driven gear box (rather than an electric motor) and therefore must be coupled to a separate metering valve via suitable fuel lines, which increases expense and occupies additional space.

SUMMARY OF THE INVENTION

The inventor of the present invention has recognized that a compact and reliable fuel delivery system meeting the stringent requirements of rocket and jet engine applications could be achieved using a specially designed constant pressure, cam operated metering pump with rolling diaphragms that prevent degradation of the pump from fuel and contaminants.

Specifically, the present invention provides a system for supplying combustible fuel to a fuel consuming device. The deliver system includes a fuel metering pump pumping combustible fuel from a fuel source through a fuel line to the fuel consuming device. The fuel metering pump has a housing defining an outlet port and an inlet port. The inlet port is in communication with the fuel source and a pair of pump chambers. Each pump chamber is sealed by a diaphragm to which is connected a pumping member biased at one end to abut a motor driven face cam. The face cam is operated by the motor to alternately reciprocate the pumping members through pump and suction strokes within the pump chambers. The fuel metering pump meters substantially constant pressure fuel through the fuel line to the fuel consuming device without the need for an accumulator or separate metering valve.

In a preferred form, the fuel consuming device is a gas turbine, rocket or jet engine. The gas turbine engine may be for a stationary or land-based vehicular applications or for propulsion of air and space vehicles. The fuel delivery system, however, is also particularly suited for use with fuel cells.

In another preferred form, the fuel source includes a fuel tank and the pump housing is mounted to the fuel tank over an opening therein. In this way, no input fuel lines are required and the vapor-to-liquid ration of the pump is maximized.

In yet another preferred form, the fuel delivery system of the present invention further include an electronic controller for controlling the speed of an electric motor driving the face cam. A speed sensor is electrically coupled to the controller and positioned near the circumference of the face cam. The face cam has teeth at its circumference that are detected by the sensor and used by the controller to operate the motor.

One aspect of the invention is that the face cam includes an increasingly ramped cam surface extending through more than 180 degrees, which abuts cam followers to move the pumping members through the pump and suction strokes. Preferably, the raised ramped surface extends to 200 degrees providing a 20 degree overlap wherein both pumping members are in the pump stroke. This provides a smooth transition from the pumping stroke to the suction stroke of each pumping member. In this way, the face cam imparts a constant velocity motion to the pumping members so as to minimize pressure ripple associated with swash plates of traditional piston pumps. This non-pulsating fuel flow makes the pump particularly well suited for use in high precision applications such rockets and jet engines.

Another aspect of the invention is that the ambient side of the pump chambers is sealed from the fuel by the diaphragms, which prevent fuel, contaminants and debris from entering the cam chamber and the electric motor. This also obviates the need for expensive close fitting surfaces in the pump chambers with highly polished surfaces. As such, little or no internal friction occurs, which maximizes efficiency and resistence to contaminated fuel. The seal of the diaphragms ambient air in the pump chambers to vent to the cam chamber of the housing. The pumping action then causes equal cross-transfer of displaced air volume, thereby eliminating pressure build up in the pump chambers. Moreover, the seal of the diaphragm eliminates the need for an external motor shaft seal.

The present invention also provides a fuel metering pump suitable for delivering fuel to rockets and jet engines. Specifically, the pump includes a drive mechanism comprising a drive motor having an axial shaft and a disk-shaped face cam mounted to the motor shaft having a ramped cam surface at an outer face. The ramped cam surface of the face cam extends radially more than 180 degrees so that both pump mechanisms are simultaneously in the pump stroke for a portion of the pump stroke and so that the pumping members alternately reciprocate through the suction and pump strokes at essentially a constant velocity. The pump also includes a pair of pumping members movable through opposite suction and pump strokes and disposed in separate pump chambers defined by a housing mounted over an orifice of a fuel tank. The housing has an inlet controlled by a reed valve to be in communication with the fuel. Each pumping member includes a cam roller biased against the face cam by a spring so as to be contacted by the ramped cam surface. A connector rod is connected to the cam roller at one end and a head plate is connected at the opposite end of the connector rod. A fuel resistant diaphragm is attached to the head plate so as to roll back as the pumping members are moved through the suction and pump strokes.

These and still other advantages of the present invention will be apparent from the description of the preferred embodiments which follow.

BRIEF DESCRIPTION OF THE DRAWINGS

FIG. 1 is a schematic view of the fuel delivery system of the present invention;

FIG. 4 is a break out view of a speed sensor positioned adjacent an edge of a face cam;

FIG. 5 shows displacement and torque curves of the fuel metering pump of the present invention.

DETAILED DESCRIPTION OF THE PREFERRED EMBODIMENT

Figure 2:
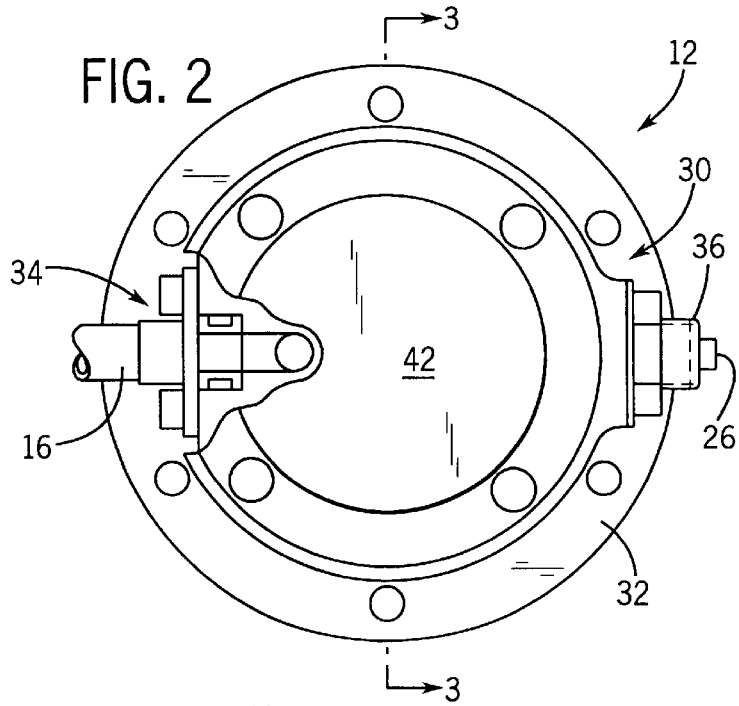
FIG. 2 is a top plan view of the fuel metering pump of the fuel delivery system cut away to show the fuel outlet connection.

The jet engine fuel delivery system of the present invention is shown schematically in FIG. 1 and is referred to generally by reference numeral 10. The fuel delivery system 10 employs a fuel metering pump 12 ("pump") mounted over an opening in an onboard fuel tank 14 to pump combustible fuel contained therein through a suitable fuel line 16 to a fuel atomizer (not shown) of a gas turbine engine 18. The gas turbine engine 18 is preferably any suitable rocket or jet engine used for stationary (or land-based vehicular) and propulsion applications. The pump 12 will be described in detail below, however, in general it is a specially designed dual chamber rolling diaphragm pump capable of precisely metering non-pulsating fuel to the jet engine 18. The pump 12 draws fuel in past inlet check valves 20 and 21 during a suction stroke and pumps out the fuel through outlet check valves 22 and 23 in fluid communication with the fuel line 16. The pump 12 is controlled by control circuitry of an onboard electronic controller 24 coupled by a control/feedback line 26.

Figure 3:
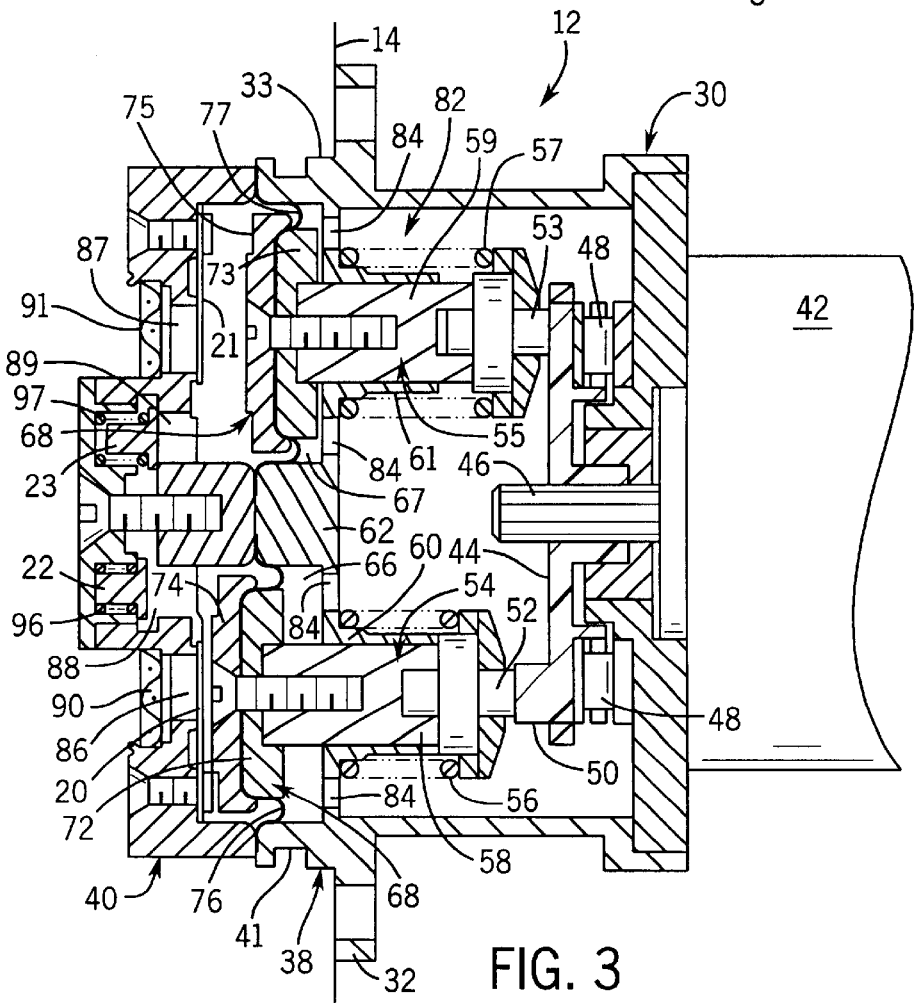
FIG. 3 is a cross-sectional view taken along line 3—3 of FIG. 2 showing pump and drive mechanisms within a pump housing.

Referring to FIGS. 2–3, the fuel metering pump 12 will now be described in detail. The pump 12 is confined in a housing 30 having a mounting flange 32 at its suction end for bolting the pump 12 to the fuel tank 14 over a suitably sized opening 33 (see FIG. 3). Fuel coupler 34 and electrical junction 36 are attached at openings in the housing 30 for connection of the fuel line 16 and the control/feedback line 26, respectively. Referring to FIG. 3, the housing 30 includes a rim 38 extending below the mounting flange 32 into the fuel tank 14 and to which is mounted a pump chamber cover 40. The rim 38 includes a circumferential groove 41 for containing a resilient seal (not shown) for sealing against the inner diameter fuel tank opening 33. Since the pump 12 is mounted to the fuel tank 14 no fuel intake lines are needed providing for a compact package and maximizing the vapor-to-liquid ratio of the pump 12. At the opposite end of the housing 30 is an opening for receiving and mounting an electric motor 42.

Referring still to FIG. 3, a circular face cam 44 is suitably mounted to a rotatable shaft 46 of the motor 42. Roller bearings 48 are disposed between the back of the face cam 44 and the face of the motor 42 to reduce axial loading on the motor 42. The face cam 44 has a ramped cam surface 50 at its front face against which ride rollers 52 and 53 of respective movable pumping members 54 and 55 aligned in parallel 180 degrees apart. The rollers 52 and 53 are biased against the cam surface 50 by springs 56 and 57 and are rotatably mounted at one end of connector rods 58 and 59, respectively. The connector rods 58 and 59 fit through respective cylindrically walled openings 60 and 61 (around which the springs are disposed) in a partition 62 of the housing 30 into respective cylindrical pump chambers 66 and 67. At the pump chamber end of the pumping members 54 and 55 are mounted pump heads 68 and 69 comprised of inner 72 and 73 and outer 74 and 75 head plates sandwiching diaphragms 76 and 77, respectively. The pump heads 68 and 70 are mounted by threaded fasteners 80 and 81 threaded into respective connector rods 58 and 59.

The pump chamber cover 40 includes cylindrical recesses that cooperate with the housing 30 to form the pump chambers 66 and 67. The diaphragms 76 and 77 are captured along their circumference between the housing 30 and the pump chamber cover 40 and are sized roll back upon itself as the pumping members 54 and 55 are reciprocated. The diaphragms 76 and 77 exhibit zero leakage so as to seal the inside of the housing 30 and prevent fuel, contaminants and debris from entering the cam chamber 82 and the electric motor 42. Thus, the pump 12 does not require close fitting surfaces in the pump chambers 66 and 67 with highly polished surfaces. As such, little or no internal friction is produced, which maximizes efficiency and resistence to contaminated fuel. Moreover, there is no need for an external motor shaft seal.

The seal of the diaphragms 76 and 77 also allows the partition 62 to have a plurality of openings 84 in communication with the pump chambers 66 and 67. The openings 84 allow air to vent from within the ambient side of the pump chambers 66 and 67 to the cam chamber 82 of the housing 30. The pumping action then causes equal cross-transfer of displaced air volume, thereby eliminating pressure build up in the pump chambers 66 and 67.

The pump chamber cover 40 includes the inlet ports 86 and 87 and outlet ports 88 and 89. The inlet port 86 and outlet port 88 are in fluid communication with pump chamber 66 and are controlled by inlet check valve 20 and outlet check valve 22. Similarly, the inlet port 87 and outlet port 89 are in fluid communication with pump chamber 67 and are controlled by inlet check valve 21 and outlet check valve 23. The inlet ports 86 and 87 are also covered by mesh screens 90 and 91 to further ensure that debris and contaminants do not enter the pump chambers 66 and 67.

Referring to FIGS. 4 and 5A the housing 30 also has an opening leading to the cam chamber 82 for a speed sensor 92 connected to electrical junction 36 through an opening in the housing 30 which in turn is connected to the controller 24 via line 26 (see FIGS. 1 and 2) forming a motor control/feedback loop. The speed sensor 92 is preferably a suitable proximity sensor positioned adjacent the edge of the face cam 44 which includes radial teeth 94 (one shown) having gaps therebetween. The speed sensor 92 detects each tooth 94 and emits a pulse the frequency of which is determined by the number of teeth on the outer diameter of the face cam 44 and its rotational velocity. The pulse signal can be used directly or after digital-to-analogue conversion, depending upon the capabilities of the controller 24. The controller 24 then uses this information to adjust the electric motor 42 as needed to compensate for differences between actual and expected motor speeds and corresponding fuel flow rates. Specifically, a computer model of pump speed is generated by the controller 24 (or an external processor) to analyze stability and gross transients. Speed loop gains are determined, preferably using a proportional-integral-derivative loop, and a close loop response is determined.

In one preferred embodiment, the pump 12 is approximately 2.7 inches in diameter, 4.75 inches in length and weighs 2.25 lbs. The motor 42 is a brush D.C. motor with a rated current of 2.0 amps and a stall current of 6.0 amps. The housing 30, pump chamber cover 40, connector rods 58 and 59, face cam 44, and head plates 72–75 are anodized aluminum providing for the low weight of the pump 12. The diaphragms 76 and 77 are preferably a fluorosilicone coated fabric material having a minimum shelf life in excess of ten years. The rollers 52 and 53 are a thin dense chrome and the roller bearings 48 are standard steel bearings and the springs 56 and 57 are suitable compression springs. The inlet check valves 20 and 21 are a deflecting reed type valve for low inertia and pressure drop across the inlet ports 86 and 87, preferably less then 1.0 psid at 400 pph. The outlet check valves 22 and 23 are preferably spring loaded flat poppet type valves. The poppet springs 96 and 97 bias the respective outlet check valves 22 and 23 to close the outlet ports 88 and 89 in the event of positive tank pressure. The inlet screens 90 and 91 preferably filter particles larger than 100 microns.

This construction provides a pump 12 that is rated at 300 pph with a maximum of 400 pph and a controllable flow range of 20–400 pph correlating to a 20/1 turndown ratio. The pump has a rated pressure rise of 30 psid and the speed ranges from 0 to 4,200 rpm. The pressure at motor stall is 190 psid minimum at −40 degrees F.

Referring now to FIGS. 5 and 6, operation of the electric motor 42 rotates the face cam 44 which in turn reciprocates the pumping members 54 and 55 via the cam surface 50 contacting the rollers 52 and 53. The cam surface 50 is specially designed to define a cam profile in which the ramped portion extends through more than 180 degrees. Preferably, the ramped cam surface 50 extends through 200 degrees such that there is 20 degrees of overlap in which both pumping members 54 and 55 are moving in a pump stroke for 10 degrees of rotation.

Referring in particular to FIG. 6, the cam surface 50 includes 180 degree upward linear ramp with a flattened ramp for 20 degrees. The flattened ramp is roughly one-half the slope of that from 0 to 180 degrees. The cam surface 50 ramps down linearly from 200 to 315 degrees and is flat to 360 degrees. Referring to FIG. 5, the pump displacement of pumping member 54 is shown by line A and for pumping member 55 by line B and the pump torque is illustrated by line C based upon a 30 psid rise to the fuel atomizer of the jet engine. As shown, pumping member 54 (line A) is in the pump stroke from 0 to 200 degrees of the face cam 44 and in the suction stroke from 201 to 359 degrees. The pumping member 55 (line B) is in the pump stroke from 180 to 20 degrees and in the suction stroke from 21 to 179 degrees of the face cam 44.

Figure 6A:
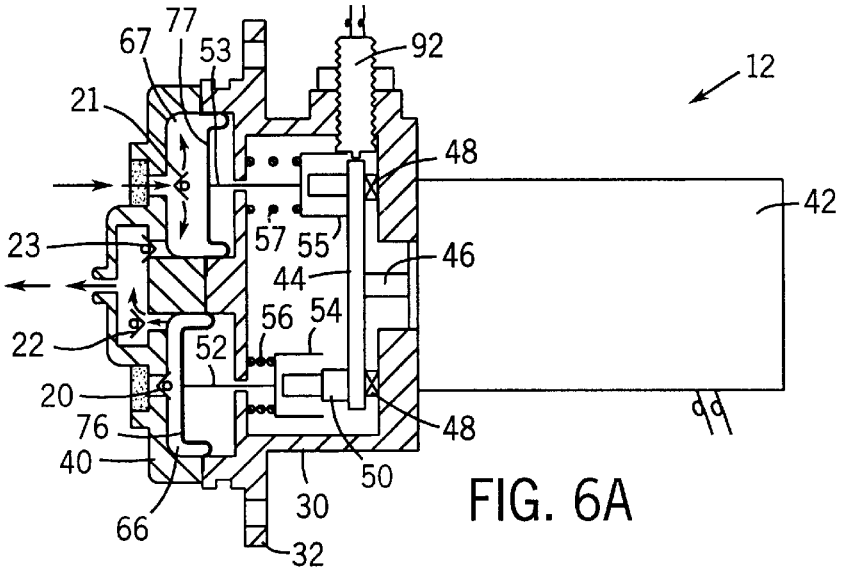
FIGS. 6A–6C illustrate the pump and drive mechanisms at three positions of the cam profile.
Figure 6B:
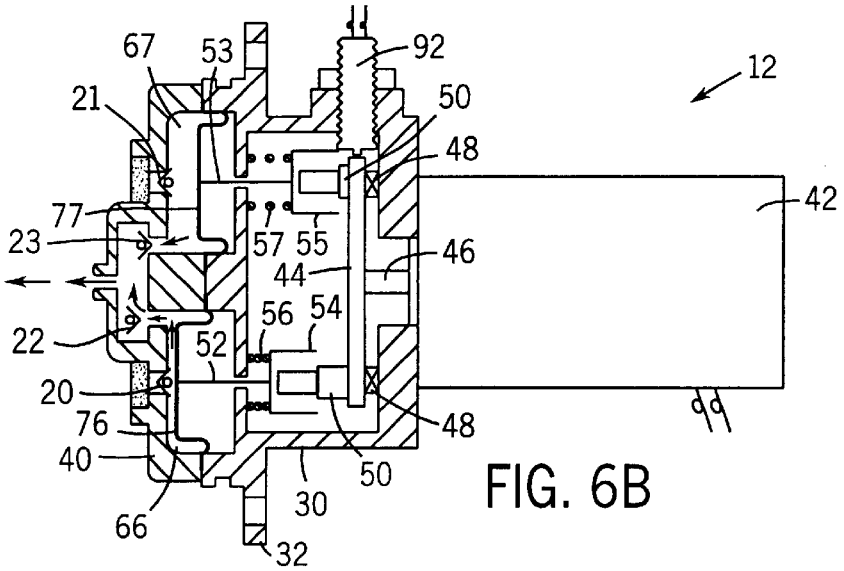
Figure 6C:
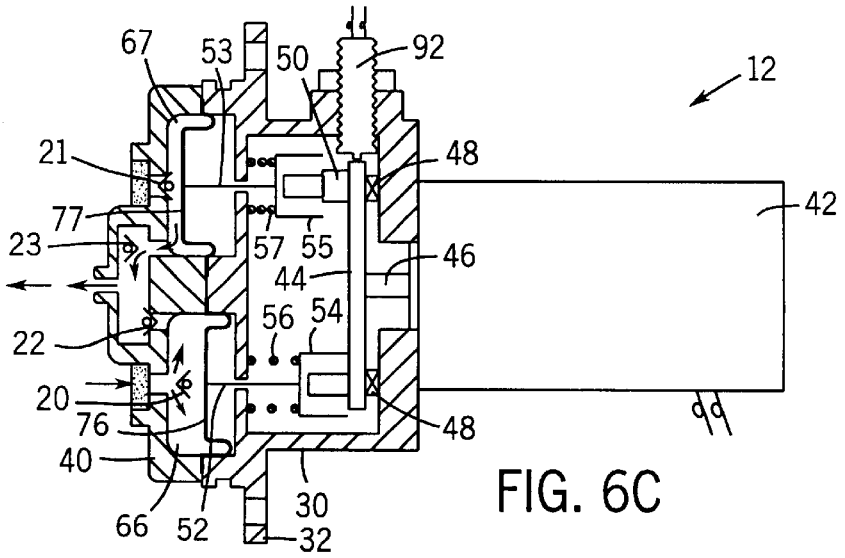

Thus, as shown diagrammatically in FIG. 6A, the pumping member 54 pumps out fuel and pumping member 55 draws in fuel when the face cam 44 is rotated through 0–180 degrees. As it rotates continues to rotate through 200 degrees, the pump 12 is as shown in FIG. 6B with both pumping members 54 and 55 in the pump stroke, however, with pumping member 54 nearing the end and pumping member 55 just beginning. As illustrated by line C of FIG. 5, the pump 12 provides a peak torque of approximately 15.5 oz.-in. during this overlap portion of the cam surface 50 wherein both pumping members 54 and 55 are in the pump stroke. As the face cam 44 finishes its rotation, the pump is as shown in FIG. 6C, with the pumping member 54 in the suction stroke and the pumping member 55 in the pump stroke.

The cam surface 50, in particular the overlapping portion, provides a smooth transition from the pumping stroke to the suction stroke of each pumping member 54 and 55. In this way, the face cam 44 imparts a constant velocity motion to the pumping members 54 and 55, at any motor speed, so as to minimize pressure ripple associated with swash plates of traditional piston pumps. This non-pulsating fuel flow makes the pump 12 particularly well suited for use in high precision applications such rockets and jet engines.

The present invention may include other aspects not specifically delineated in the aforementioned preferred embodiments. For example, the size and speed of the electric motor can be varied. Also, the above described a tank mounted embodiment, however, it is possible for the fuel metering pump to be connected to the fuel source inline with suitable fuel lines. Moreover, the fuel metering pump could be used in a fuel delivery system having a fuel cell as the fuel consuming device. Thus, the above in no way is intended to limit the scope of the invention. Accordingly, in order to apprise the public of the full scope of the present invention, reference must be made to the following claims.

What is claimed is:

1. A system for supplying combustible fuel to a fuel consuming device, the system comprising:

a combustible fuel source;

a fuel metering pump having a housing defining an outlet port and an inlet port, the inlet port being in communication with the fuel source and leading to a pair of pump chambers, each pump chamber being sealed by a diaphragm to which is connected a pumping member biased at one end to a but a motor driven face cam operating to alternately reciprocate the pumping members through pump and suction strokes within the pump chambers; and a fuel line leading from the outlet port to the fuel consuming device;

the fuel metering pump further comprising means for fuel metering and pumping substantially constant pressure fuel to the fuel consuming device without the need for an accumulator metering valve.

2. The system of claim 1, wherein the fuel consuming device is selected from the group consisting of: a rocket, a jet engine and a fuel cell.

3. The system of claim 1, wherein the fuel source includes a fuel tank and the pump housing is mounted to the fuel tank over an opening therein.

4. The system of claim 1, wherein the face cam includes a cam surface and the pumping members each include a cam follower matable with the cam surface for movement through the pump and suction strokes.

5. The system of claim 4, wherein the cam surface defines a ramp extending through more than 180 degrees.

6. The system of claim 4, wherein the fuel metering pump further includes a pair of springs disposed within the housing about the pumping members to bias a cam follower end of the pumping members against the cam surface of the face cam.

7. The system of claim 6, wherein the cam follower end includes a roller.

8. The system of claim 1, further including an electronic controller for controlling the speed of an electric motor driving the face cam.

9. The system of claim 8, further including a speed sensor electrically coupled to the controller and positioned near the circumference of the face cam and wherein the face cam includes radial teeth at its circumference that are detected by the sensor.

10. The system of claim 1, wherein an ambient side of the pump chambers sealed from the fuel by the diaphragm and is vented to the ambient air.

11. The system of claim 1, further including a check valve operable by the pumping members to open and close the inlet port.

12. The system of claim 11, wherein the check valve is a flexible reed type valve.

13. The system of claim 11, further including a screen covering the inlet port.

14. A fuel metering pump suitable for delivering fuel to rockets and jet engines, comprising:

(1) a drive mechanism including:

(A) a drive motor having an axial shaft;

(B) a disk-shaped face cam mounted to the motor shaft and having a ramped cam surface at an outer face; and (2) a pair of pumping members disposed in separate pump chambers defined by a housing mounted over an orifice of a fuel tank, the housing having an inlet controlled by a reed valve to be in communication with the fuel and each pumping member being movable through opposite suction and pump strokes and including:

(A) a cam roller biased against the face cam by a spring so as to be contacted by the ramped cam surface;

(B) a connector rod connected to the cam roller at one end;

(C) a head plate connected to the connector rod at an end opposite the cam roller;

(3) a fuel resistant diaphragm sealing openings to the pump chambers and attached to the head plate so as to roll back as the pumping members are moved through the suction and pump strokes;

wherein the ramped cam surface of the face cam extends radially more than 180 degrees so that both pump mechanisms are simultaneously in the pump stroke for a portion of the pump stroke and the pumping members alternately reciprocate through the suction and pump strokes at essentially a constant velocity.

15. The fuel metering pump of claim 14, further including a speed sensor positioned near the circumference of the face cam and wherein the face cam includes radial teeth at its circumference that are detected by the sensor.

16. The fuel metering pump of claim 14, wherein an upstream side of the pump chambers sealed from the fuel by the diaphragm and is vented to the ambient air.

17. The fuel metering pump of claim 14, further including a screen covering the inlet port.

* * * * *

UNITED STATES PATENT AND TRADEMARK OFFICE

CERTIFICATE OF CORRECTION

PATENT NO. : 6,371,740 B1
DATED : April 16, 2002
INVENTOR(S) : Harvey B. Jansen

It is certified that error appears in the above-identified patent and that said Letters Patent is hereby corrected as shown below:

Column 6,
Line 48, “a but” should be -- abut --.

Signed and Sealed this

Twenty-sixth Day of November, 2002

*Attest:*

*Attesting Officer*

JAMES E. ROGAN
*Director of the United States Patent and Trademark Office*